US006845224B1

(12) United States Patent
Gross et al.

(10) Patent No.: US 6,845,224 B1
(45) Date of Patent: Jan. 18, 2005

(54) METHOD AND APPARATUS FOR TIMING ADJUSTMENT FOR TRANSFER ASSIST BLADE ACTIVATIONS

(75) Inventors: Robert A. Gross, Penfield, NY (US); Youti Kuo, Penfield, NY (US); David K. Ahl, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 15 days.

(21) Appl. No.: 10/630,029

(22) Filed: Jul. 30, 2003

(51) Int. Cl.[7] ..... G03G 15/16
(52) U.S. Cl. ..... 399/316; 399/317
(58) Field of Search ..... 399/297, 310, 399/311, 312, 314, 316, 317, 318

(56) References Cited

U.S. PATENT DOCUMENTS

| | | | | |
|---|---|---|---|---|
| 4,947,214 | A | 8/1990 | Baxendell et al. | |
| 5,227,852 | A | 7/1993 | Smith et al. | |
| 5,247,335 | A | 9/1993 | Smith et al. | |
| 5,300,393 | A | 4/1994 | Odell et al. | 430/134 |
| 5,300,994 | A | 4/1994 | Gross et al. | |
| 5,539,508 | A | 7/1996 | Piotrowski et al. | |
| 5,543,896 | A | 8/1996 | Mestha | |
| 5,568,238 | A | 10/1996 | Osbourne et al. | |
| 5,574,527 | A | 11/1996 | Folkins | |
| 5,606,721 | A | 2/1997 | Thayer et al. | 399/34 |
| 5,613,179 | A | 3/1997 | Carter et al. | 399/316 |
| 5,687,297 | A | 11/1997 | Coonan et al. | 395/102 |
| 5,923,921 | A | 7/1999 | OuYang et al. | 399/66 |
| 6,069,624 | A | 5/2000 | Dash et al. | 345/333 |
| 6,188,863 | B1 | 2/2001 | Gross et al. | 399/316 |
| 6,272,295 | B1 | 8/2001 | Lindblad et al. | 399/26 |
| 6,330,418 | B1 * | 12/2001 | Ahl et al. | 399/311 |
| 6,377,761 | B1 | 4/2002 | Nichols | 399/9 |
| 6,556,805 | B1 | 4/2003 | Kuo et al. | 399/316 |
| 6,687,480 | B2 * | 2/2004 | Obrien et al. | 399/316 |

* cited by examiner

*Primary Examiner*—Hoang Ngo
(74) *Attorney, Agent, or Firm*—Richard F. Spooner

(57) ABSTRACT

An apparatus and method for automatically adjusting the timing of a transfer assist blade in an electrostatographic imaging system. The apparatus and method operate by partially toning an area of the photoreceptor and then actuating the transfer assist blade such that it smears at least a portion of the partially toned area. Using an electronic toner area cover sensor system, the amount of smearing can be determined, From this, the timing of engagement of the transfer assist blade with the photoreceptor can be determined and, if necessary, adjusted.

32 Claims, 6 Drawing Sheets

METHOD AND APPARATUS FOR TIMING ADJUSTMENT FOR TRANSFER ASSIST BLADE ACTIVATIONS

FIELD OF THE INVENTION

The present invention relates generally to a copier or printing system, and, more specifically, concerns a method for automatically adjusting the timing of a subsystem that assists the transfer of a toned image from an imaged surface to a copy substrate.

BACKGROUND AND SUMMARY

The function of transfer assist blades is generally for pressing a copy substrate into intimate contact with the toner particles on a selectively charged imaging surface, for example, the photoreceptor, during image transfer from the charged imaging surface onto the copy substrate. In particular, non-flat or uneven image support substrates, such as copy sheets that have been mishandled, paper that has been left exposed to the environment, or substrates that have previously passed through a fixing operation (for example, heat and/or pressure fusing) often tend to yield imperfect contact with the photoconductive surface. Some printing applications require imaging onto high quality papers having surface textures which prevent intimate contact of the paper with the developed toner images. In duplex printing systems, even initially flat paper can become cockled or wrinkled as a result of paper transport and/or the first side fusing step. Also, color images can contain areas in which intimate contact of toner with paper during the transfer step is prevented due to adjacent areas of high toner pile heights. The lack of uniform intimate contact between the belt and the copy sheet in these situations can result in spaces or air gaps between the developed toner powder image on the selectively charged imaging surface and the copy substrate. When spaces or gaps exist between the developed image and the copy substrate, various problems may result. For example, there is a tendency for toner not to transfer across gaps, causing variable transfer efficiency and, under extreme circumstances, creating areas of low toner transfer or even no transfer, resulting in a phenomenon known as image transfer deletion.

In order to minimize transfer deletions, transfer assist blades (TABs) have been utilized to press the back of the copy substrate against the imaged area of the charged imaging surface. Variations and improvements upon transfer assist blades are well known in the art. See, for example, U.S. Pat. No. 4,947,214 issued to Baxendell, et al.; U.S. Pat. No. 5,227,852 issued to R. Smith et al.; U.S. Pat. No. 5,300,393 issued to Vetromile; U.S. Pat. No. 5,300,994 issued to Gross et al.; U.S. Pat. No. 5,539,508 issued to Piotrowski et al.; U.S. Pat. No. 5,613,179, issued to Carter et al.; and U.S. Pat. No. 5,568,238, issued to Osbourne et al. In each of these disclosures, the transfer assist blade is moved from a nonoperative position spaced from the copy substrate, to an operative position, in contact with the copy substrate for pressing the copy sheet into contact with the developed image on the photoconductive or other charged imaging surface in order to substantially eliminate any spaces therebetween during the transfer process. The entire disclosures of the above-referenced patents are hereby incorporated by reference for their relevant teachings.

As a specific example from the above list of patents, U.S. Pat. No. 5,247,335, issued to: R. Smith et al. discloses a transfer assist blade for ironing a sheet against a photoreceptor belt during transfer, thereby smoothing out deformities that cause deletions. The transfer assist blade includes a flexible tip to absorb the impact of the blade as it contacts the paper arid a spring load to limit and control the force applied to the sheet.

As taught in the prior art, no portion of the transfer assist blade should contact the imaging surface since such contact will result, in ;Most instances, in the pick up of residual dirt and toner from the charged imaging surface onto the portion of the transfer assist blade that contacts the imaging surface. Also, contact by the TAB onto the charged imaging surface risks abrading such surface, therefore adversely affecting subsequent image quality and shortening the expected life of the expensive photoreceptor or other charged imaging surface. In order to ensure that a transfer assist blade contacts the COPY sheet only within the copy substrate perimeter, either the transfer assist blade must be shortened to correspond to the narrowest copy sheet width expected to be processed in the printer or there must be added an apparatus for detecting the width of each copy sheet and varying the effective length of the transfer assist blade to correspond to the width of such sheet. Apparatus such as those disclosed in U.S. Pat. No. 5,300,994 and U.S. Pat. No. 5,539,508 are capable of varying the effective length of the transfer assist blade when operating in conjunction with appropriate sensors and algorithms.

The described ability to vary the length of the TAB enables the TAB to be adjustable in the direction perpendicular to the paper path. For the same reasons that the length of the TAB may be adjusted, it is also important that the TAB be raised and lowered so as not to contact the photoreceptor or other charged imaging surface. As a counterpoint, it is also important that the TAB contact the back of the copy substrate as close as possible to the leading and trailing edges of the copy substrate in order to ensure contact in all imaging areas. A high degree of accuracy is therefore required in timing engagement and disengagement of the TAB with the copy substrate. Such engagements and disengagements of the TAB are generally designed as timed sequences in relation to paper path speed and the sensed width in the paper path of the copy substrate. As an example, U.S. Pat. No. 6,556,805, issued to Kuo et al., teaches a method of activating TAB segments by rotating one of more cam shafts, thereby pressing the TAB into contact with the copy substrate when the appropriate cam lobe has been rotated sufficiently to press the TAB toward the copy substrate. Another system for activating TAB motions is taught in U.S. Pat. No. 6,188,863, issued to Gross et al. Any number of other systems have been utilized and many more are possible.

In the cam system taught by U.S. Pat. No. 6,556,805 and in other TAB cam systems, there is a timing delay between commencement of rotation by the cam shaft and contact between the TAB and the copy substrate. Other activation systems also have such delays between activation of the system and contact between TAB and copy substrate. Similarly, there is a timing delay between sensing of the leading or trailing edge of a copy substrate and actuation or deactivation of the cam shaft rotation or other mechanism that urges the TAB toward the copy substrate. Such timing sequences are typically handled during machine design and initial system calibration. Conventionally, the calibration is performed manually by such means as attaching an ink pad to the blade, measuring the length of the mark that the pad makes on the back of a copy sheet, and calculating the required adjustment time to achieve the desired length of such mark.

As printing system speeds increase, the speed of the copy substrate along the paper path increases, and TAB activation and deactivation must be timed more perfectly to ensure proper placing of the TAB as close as possible to the leading and trailing edges. Moreover, initial calibrations of the timing sequence may be obsoleted as components affecting the sequence are replaced over time with replacement components that vary slightly in response time, size, shape, etc. In particular, a replacement TAB can vary slightly in length, thickness, position within its mounting, and each of these factors may affect the timing of TAB contact with a copy substrate. Additionally, normal wear and tear and "settling in" of cams, motors, gears, photoreceptor belts, and other components can affect the precise timing sequence of TAB actuation apparatus. Additional calibrations are possible but typically require the time, expense, and labor of service and maintenance calls. It would be advantageous for electrostatographic imaging systems utilizing TAB-type devices to have an automated timing adjustment system wherein the timing of TAB activation and deactivation is automatically adjusted in response to any of the changes that may affect the TAB timing sequence.

In accordance with the claimed embodiments, there is provided an apparatus for adjusting the timing of contact between a transfer assist blade and a charged imaging surface in order that the timing be automatically adjusted within specifications, said apparatus comprising: an imaging apparatus for developing a partially toned pattern having about 20 to about 80 percent coverage in a region of a charged imaging surface; a transfer assist blade assembly, including a transfer assist blade, for moving a transfer assist blade between a position engaged with a surface and a position disengaged from such surface; a drive device, connected to the transfer assist assembly, for imparting engagement and disengagement motion to the transfer assist blade, said drive device having an activation time for engaging the transfer assist blade with the surface and a deactivation time for disengaging the transfer assist blade from the surface; a toner area coverage measuring device for measuring the percentage of the partially toned region that is covered by toner; and a controller, in communication with the drive device and area coverage measuring device, for adjusting the timing of activation of the drive device, wherein, in response to receiving signals from the toner area coverage measuring device indicating that the time of activation resulted in engagement of the transfer assist blade outside of the specifications, the controller adjusts the timing of activation accordingly.

Pursuant to another aspect of the claimed embodiments, there is provided an electrostatographic imaging system having specifications for engaging a transfer assist blade with a charged imaging surface, comprising: a charged imaging surface; an imaging apparatus for developing a partially toned pattern having about 20 to about 80 percent coverage in a region of a charged imaging surface; a transfer assist blade assembly, including a transfer assist blade, for moving a transfer assist blade between a position engaged with a surface and a position disengaged from such surface; a drive device, connected to the transfer assist assembly, for imparting engagement and disengagement motion to the transfer assist blade, said drive device having an activation time for engaging the transfer assist blade with the surface and a deactivation time for disengaging the transfer assist blade from the surface; a toner area coverage measuring device for measuring the percentage of the partially toned region that is covered by toner; and a controller, in communication with the drive device and area coverage measuring device, for adjusting the timing of activation of the drive device, wherein, in response to receiving signals from the toner area coverage measuring device indicating that the time of activation resulted in engagement of the transfer assist blade outside of the specifications, the controller adjusts the timing of activation accordingly.

In accordance with yet another aspect of the claimed embodiments, there is provided a method for automatically adjusting the timing of engagement of a transfer assist blade with a charged imaging surface, comprising: commencing a sequence for adjustment of the engagement timing; developing a partially toned pattern having about 20 to about 80 percent coverage in a region of the charged imaging surface; activating a drive device that moves a transfer assist blade from a disengaged position to an engaged position at a time estimated to engage the transfer assist blade within a specified portion of the partially toned region; reading, by a controller, a signal from a toner area coverage sensor indicating the portion of the partially toned region that is smeared by the transfer assist blade; determining, with a controller, from the signal from the toner area coverage sensor, whether the transfer assist blade engaged the charged imaging surface within specifications; adjusting, in response to determining that the time of engagement was not within specifications, the time of activation of the drive device in order to meet specifications.

BRIEF DESCRIPTION OF THE DRAWINGS

Other aspects of the present embodiments will become apparent as the following description proceeds and upon reference to the drawings, in which.

DESCRIPTION

Figure 1:
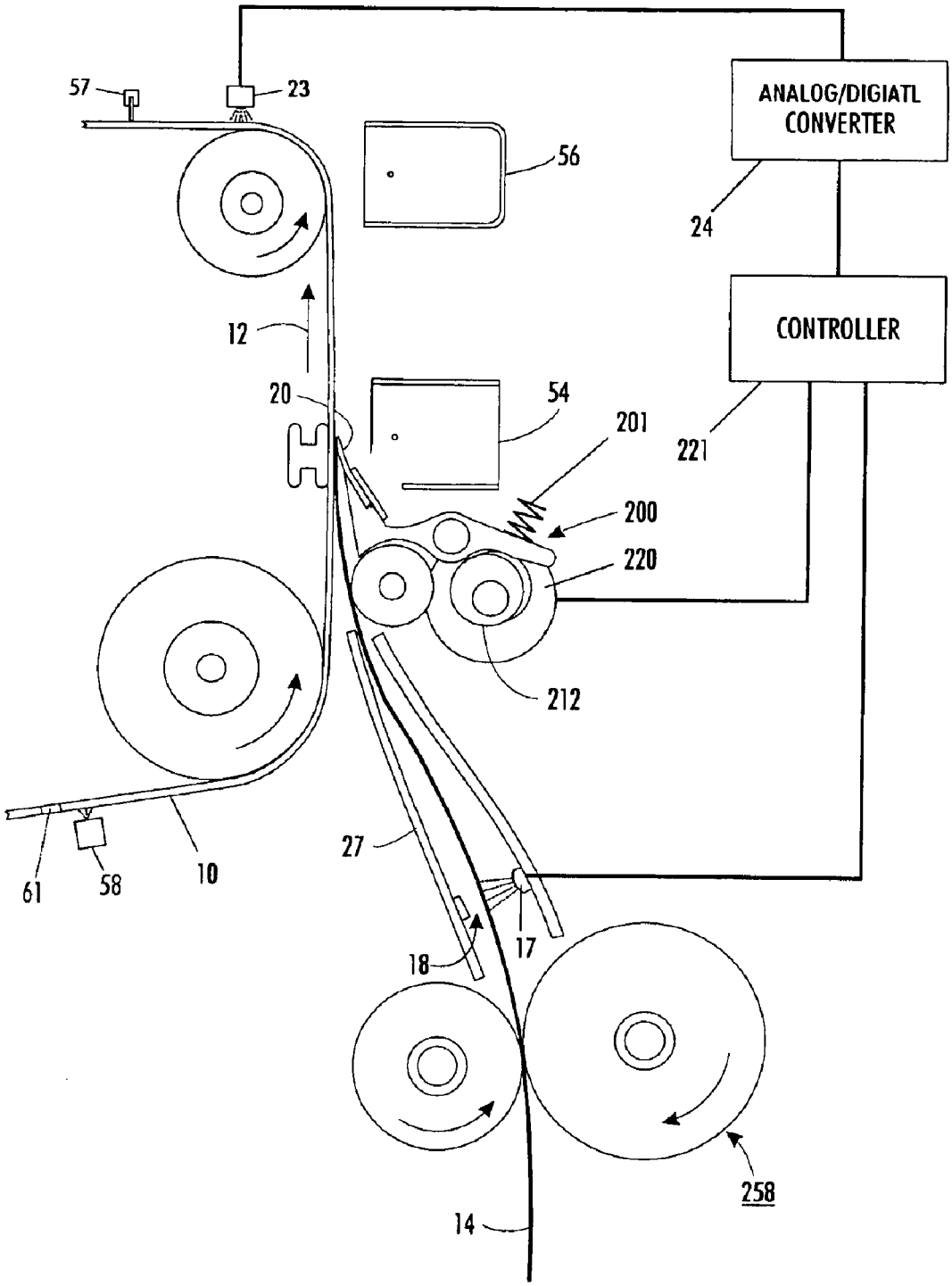
FIG. 1 is a schematic elevational view of one embodiment of the invention showing elements of the claimed invention.

For a general understanding of the present embodiments, reference is made to the drawings. In the drawings, like reference numerals have been used throughout to designate identical elements.

An exemplary imaging system comprising one embodiment of the present invention is a multifunctional printer with print, copy, scan, and fax services. Such multifunctional printers are well known in the art and may comprise print engines based upon liquid or solid ink jet, electrophotography, other electrostatographic technologies, and other imaging technologies. The general principles of electrophotographic imaging are well known to many skilled in the art and are described above as an exemplary embodiment of an imaging system to which the present invention is applicable.

A typical electrostatographic copying or printing process uses a photoconductive member that is charged to a substantially uniform potential, and the charged portion of the photoconductive member is subsequently exposed to a light image of a document being reproduced or printed. Exposure of the charged photoconductive member selectively dissipates the charge thereon in the irradiated areas so as to record on the photoconductive member an electrostatic latent image corresponding to the informational areas contained within the original document. After the electrostatic latent image is recorded on the photoconductive member, the latent image is developed by bringing a developer material into contact therewith. Generally, the developer material is made from toner particles adhering triboelectrically to carrier granules. The toner particles are attracted from the carrier granules to the latent image to form a toner powder image on the photoconductive member. The toner powder image is then transferred from the surface of the photoconductive member to a copy substrate such as a sheet of paper. Thereafter, heat or some other treatment is applied to the toner particles to permanently affix the powder image to the copy substrate. In a final step in the process, the photoconductive surface layer of the photoreceptive member is cleaned to remove any residual developing material therefrom, in preparation for successive imaging cycles.

The process of transferring charged toner particles from an image bearing member such as the photoconductive member to an image support substrate such as the copy sheet is enabled by overcoming adhesive forces holding the toner particles to the image bearing member. Typically, transfer of developed toner images in electrostatographic applications is accomplished via electrostatic induction using a corona generating device, wherein the image support substrate is placed in direct contact with the developed toner image on the photoconductive surface while the reverse side of the image support substrate is exposed to a corona discharge for generating ions having a polarity opposite that of the toner particles, to electrostatically attract the toner particles from the photoreceptive member and transfer the toner particles to the image support substrate.

As described, the typical process of transferring development materials in an electrostatographic system involves the physical detachment of charged toner particles from a selectively charged image bearing surface and transfer of such charged particles to an image support substrate via electrostatic force fields. A critical aspect of the transfer process involves the application and maintenance of high intensity electrostatic fields in the transfer region for overcoming the adhesive forces acting on the toner particles as they rest on the surface of the selectively charged imaging member. In addition, other forces, such as mechanical pressure or vibratory energy, have been used to support and enhance the transfer process. Careful control of electrostatic fields and other forces is essential for inducing the physical detachment and transfer of the charged toner particles without scattering or smearing of the developer material. Such scattering or smearing may result in an unsatisfactory output image.

The above described electrophotographic reproduction process is well known and is useful for both digital copying and printing as well as for light lens copying from an original. In many of these applications, the process described above operates to form a latent image on a charged imaging member by discharge of the charge in locations in which photons from a lens, laser, or LED strike the photoreceptor. Such printing processes typically develop toner on the discharged area, known as Discharge Area Development ("DAD"), or "write black" systems. Light lens generated image systems typically develop toner on the charged areas, known as Charge Area Development ("CAD"), or "write white" systems. Embodiments of the present invention apply to both DAD and CAD systems. Since electrophotographic imaging technology is so well known, further description is not necessary. See, for reference, for example, U.S. Pat. No. 6,069,624 issued to Dash, et al; U.S. Pat. No. 5,687,297 issued to Coonan et al. an U.S. Pat. No. 6,556,805, issued to Kuo et al., all of which are hereby incorporated herein by reference.

Referring to FIG. 1, an exemplary TAB embodiment within the copy transfer section of an electrostatographic imaging device is shown. As noted above, many varieties of TAB systems are possible, and this embodiment is exemplary only. TAB 20 is shown engaged with the back of copy substrate 14, thereby pressing copy substrate 14 onto photoreceptor belt ("PR") 10. Corotron 54 charges copy substrate sufficiently to urge toner particles to transfer from PR 10 to copy substrate 14. Upon exiting the transfer section, corotron 56 provides an opposite charge, thereby aiding the detacking of copy substrate 14 from PR 10. Activation and deactivation of TAB 20 is induced by rotation of cam 212 which acts upon lever 200. TAB 20 is attached to the other end of lever 200. Spring 201 biases lever 200 and attached TAB 20 toward the deactivated position. A controller 221 cooperating with leading and trailing edge sensor system, comprised of light emitter 17 and sensor array 18, determines the timing for activating a stepper motor 220 that, in turn, commences rotation of cam 212 in order that TAB 20 be in contact the back of copy substrate 14 as near as possible to both the leading and the trailing edges of such substrate. An alternative timing sequence for activation of TAB 20 involves cooperation between controller 221 and a location indicator 61 such as a hole in PR 10 rather than between the controller and leading and trailing edge sensor system 17 and 18. In this alternate timing sequence, a sensor 58 detects when the location indicator passes the sensor location and relays this information to controller 221. Since the rate of rotation of PR 10 is known, controller 221 is able to coordinate delivery of copy substrate 14 into contact with PR 10 with activation and deactivation of stepper motor 220 in order that TAB 20 contact copy substrate 14 near its leading and trailing edge. More details concerning the shown exemplary TAB system and the apparatus utilizing such TAB system can be found at U.S. Pat. No. 6,556,805, issued to Kuo. FIG. 1 is adapted from this patent.

Figure 2:
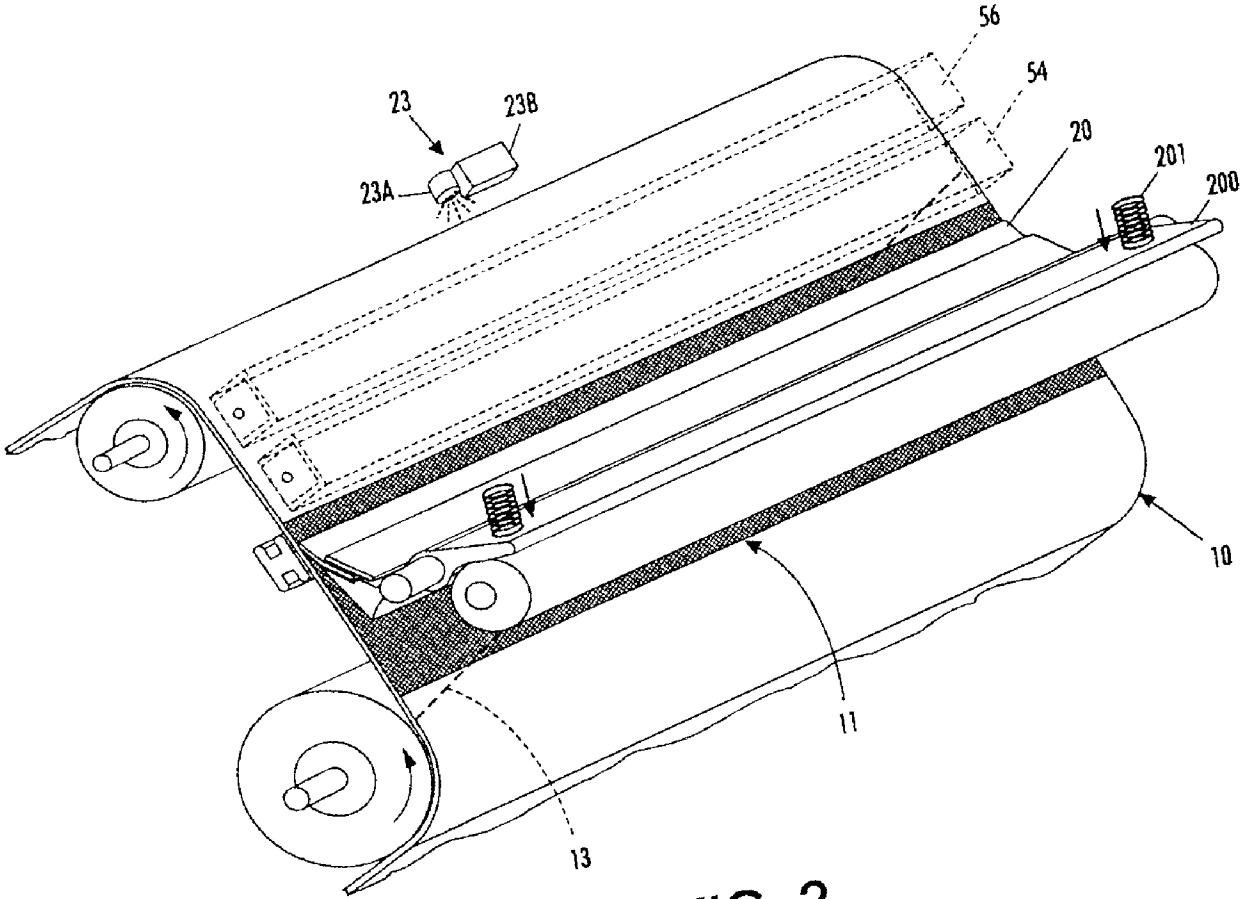
FIG. 2 is a perspective elevational view showing elements of the claimed embodiments including a transfer assist blade and a partially toned region of a charged imaging surface.

With reference next to FIG. 2, one embodiment of the apparatus and method of the claimed invention is shown. A segment of photoreceptor belt 10 is shown as it passes under TAB 20. PR 10 can alternatively be any charged imaging surface useful in electrostatographic imaging, including such surfaces as photoreceptor drums or electrostatic dielectric surfaces. Prior to arrival at the TAB station, a fifty (50) percent half-tone image has been imaged and developed in region 11 of PR 10. Such partial area coverage may be in any pattern and in any percentage of coverage sufficient for subsequent detection of image smearing when such developed area is smeared as described below. Area coverage of between about 20 and about 80 percent would typically be used and, preferably, area coverage between about 40 and about 60 percent.

Imaged region 11 may be placed in any region of PR 10 that is not currently covered by a copy substrate. Such interdocument zones may be located between document pitches, in skipped pitch areas or during PR 10 rotation sequences when no copy output is intended. A preferred area for placement of region 11 is in the seam area of PR 10 since such seam areas are typically not used for imaging purposes due to unreliability of images across the seam. In FIG. 2, region 11 is shown placed across seam 13. Such placement of region 11 across the seam area of PR 10 is preferred since the embodiment requires contact between TAB 20 and PR 10 proximate to region 11. Such direct contact with TAB 20 may abrade PR 10, and such abrasion risks degrading the imaging properties of PR 10 in the area used for region 11.

Another feature shown in FIG. 2 is an area coverage sensor system 23. For a typical monochrome sensor, sensor this sensor system 23 is an electronic toner area coverage sensor ("ETAC". Such a ETAC will be discussed herein as an exemplary sensor system 23. As shown in FIG. 1 sensor system 23 is typically disposed between the detact corotron station 56 and cleaning blade 57. ETAC's are used in modern printers and copiers to monitor and correct image quality issues by measuring toner darkness at various percentages of imaged coverage. For instance, a printing system may periodically check image quality by developing on the photoconductor 10 halftone images in interdocument zones patches imaged at such intensities as 0, 12, 50, 88, and 100 percent halftone coverage. Since such halftone regions occur in interdocument zones, no transfer to copy substrate occurs, and the developed image proceeds on PR 10 past ETAC 23 until removed from PR 10 by cleaning blade or brush 57.

The exemplary ETAC sensor 23 shown in FIG. 2 comprises a light source 23A such as an LED and a sensor array 23B for detecting light reflected off of the underlying substrate. The wave length emitted by light source 23A is generally selected for optimal reflection (or absorption) by the toner being measured. The greater the area of toner coverage, the greater (or lesser) the reflection detected by sensor 23B. In the embodiment shown, sensor 23B detects reflected photons by emitting one or more electrons for each photon received. The result is a variable voltage signal with an increase (or decrease) in voltage signifying more (less) reflected light which, in turn, indicates greater area coverage by toner. By comparing the actual voltage signal to the signal predicted in response to the percentage of halftone coverage, a controller such as controller 221 can determine if the amount of toner actually developed is less than or greater than predicted amounts. In response to variations outside of specified amounts, corrective measures can be directed to bring the amount of the developed image within specifications. For more details concerning area coverage sensors such as ETAC sensor 23, see U.S. Pat. No. 6,272,295, issued to Lindblad et al; U.S. Pat. No. 5,543,896, issued to Mestha; and U.S. Pat. No. 5,574,527 issued to Folkins, all of which are incorporated herein by reference. In U.S. Pat. No. 5,606,721 issued to Thayer et al., use of an ETAC is taught for measuring the amount of toner removed from a solid line by a cleaning blade. Since the solid line of toner in Thayer is arranged along the path of PR travel and since cleaning blades are designed to remove all toner from a contacted area (in contrast to TAB's), the ETAC in Thayer succeeds in measuring the length of contact between a cleaning blade and the PR.

Figure 3:
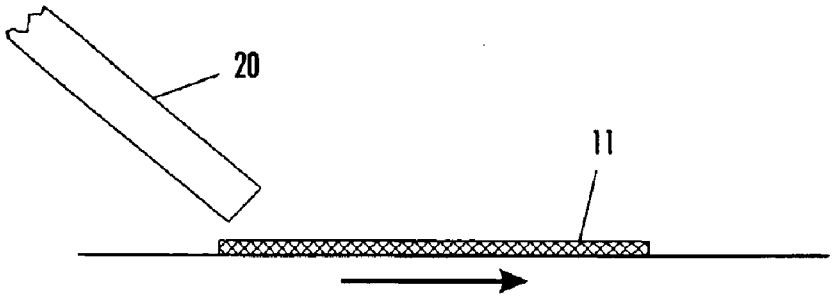
FIG. 3 is a sectional elevational view of an embodiment of the claimed invention showing the transfer assist blade disengaged from the partially toned region.
Figure 4:
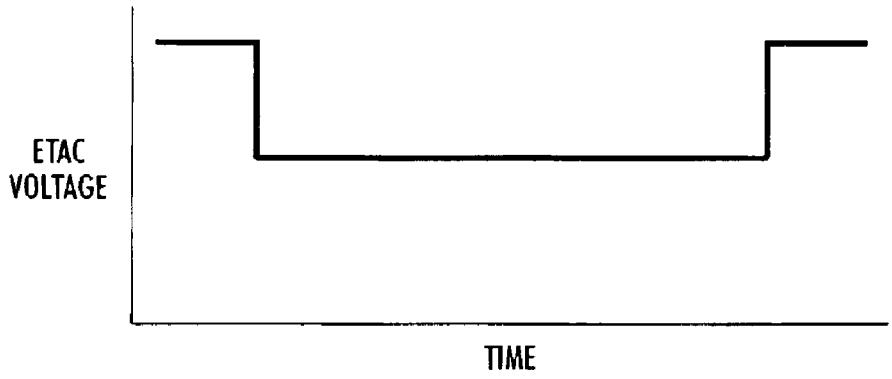
FIG. 4 is a graph showing the relationship between ETAC voltage signal and time corresponding with the disengaged status of FIG. 3.

In the example shown in FIG. 2, region 11 has passed under TAB 20 without being smeared. This indicates that TAB 20 has not yet made contact with the imaged toner in region 11. Referring now to FIG. 3, an elevational cross-sectional view represents the status of TAB 20 in relation to PR 10 in FIG. 2, i.e., TAB 20 is not in contact with PR 10 within region 11. The effect of such status upon ETAC voltage is shown in FIG. 4, where ETAC voltage is graphed versus time. The time dimension, in turn, corresponds to the distance of travel of PR 10 when the PR 10 is in motion at a constant rate as it is during imaging cycles. As shown in FIG. 4, the ETAC voltage curve corresponding to FIGS. 2 and 3 is a U-shaped trough with a flat bottom line corresponding to Region 11 since the amount of reflection across region 11 does not vary without contact between TAB 20 and PR 10. It should be noted that FIGS. 4, 6, and 8 are idealized graphs since actual measurements show continually varying voltages with steep slopes conforming to the step functions indicated in the idealized graphs.

Figure 5:
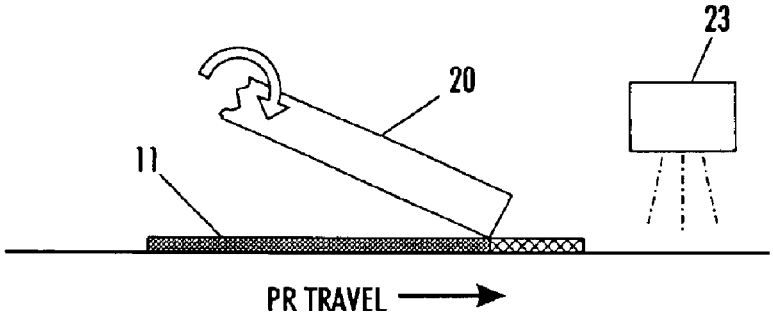
FIG. 5 is a is a sectional elevational view of an embodiment of the claimed invention showing the transfer assist blade engaged with the partially toned region.
Figure 6:
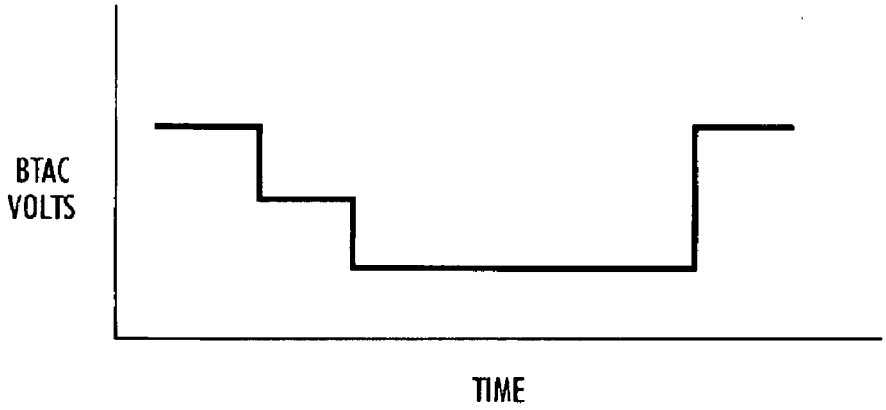
FIG. 6 is a graph showing the relationship between ETAC voltage signal and time corresponding with the engaged status of FIG. 3.

Referring now to FIGS. 5 and 6, TAB 20 has made contact with PR 10 within region 11 toward the leading edge of region 11. The result indicated by the darkened section of region 11 is that most of region 11 will be smeared to a more uniformly toned image. In FIG. 6, the ETAC voltage signal result is shown. From left to right, the signal begins at its highest voltage level measured in respect to the untoned PR 10 areas. The ETAC first encounters the unsmeared section of region 11, and the voltage signal drops to a level that reflects a 50 percent or other percentage of partially toned imaging. When the ETAC encounters the smeared region of region 11, the voltage drops further to its lowest level. Upon encountering the untoned area of PR 10, the voltage returns to its original high level.

Figure 7:
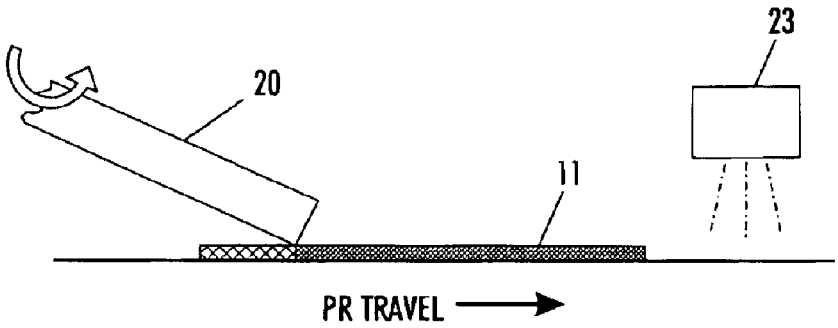
FIG. 7 is a sectional elevational view of an embodiment of the claimed invention showing the transfer assist blade engaged with the partially toned region.
Figure 8:
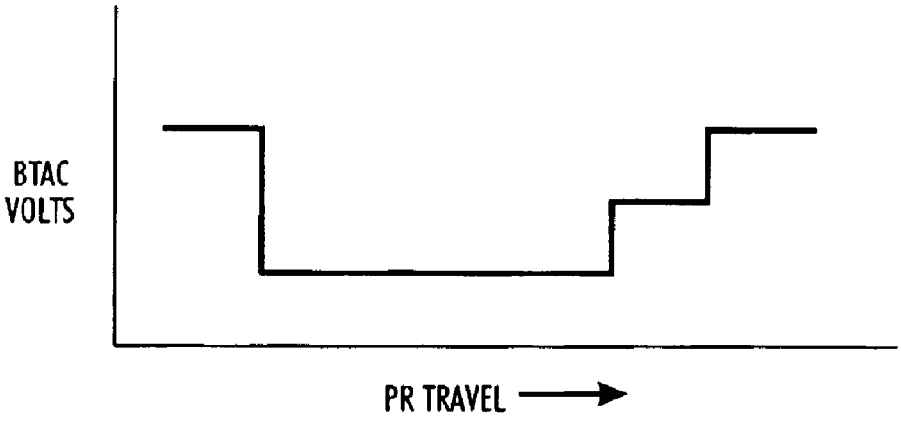
FIG. 8 is a graph showing the relationship between ETAC voltage signal and time corresponding with the engaged status of FIG. 3.
Figure 9:
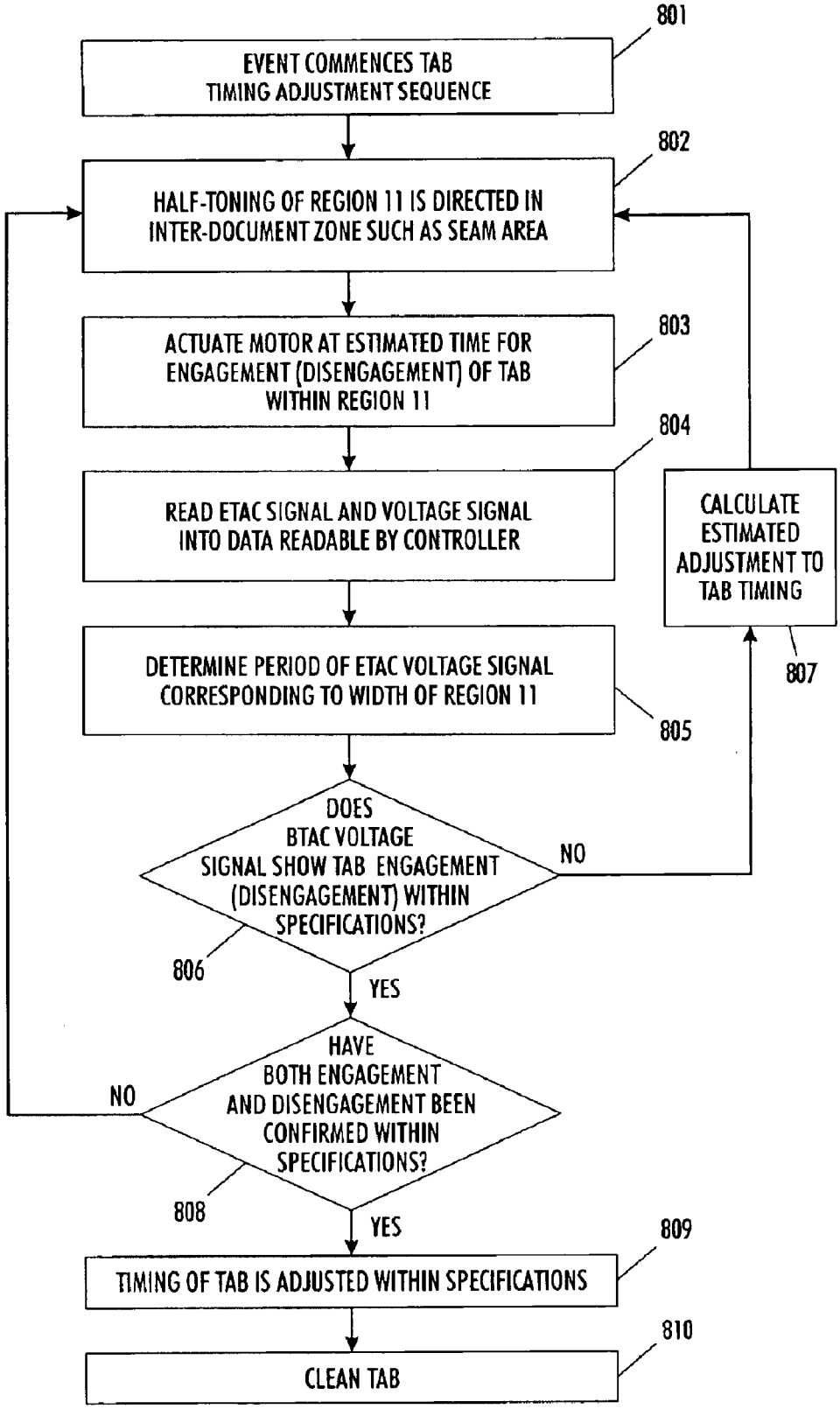
FIG. 9 is a logic sequence for adjusting the timing of engagement and disengagement of a transfer assist blade in accordance with one embodiment of the claimed invention.

Referring to FIGS. 7 and 8, a similar pattern is measured that is useful for determining when TAB 20 disengages from PR 10. In this pattern, TAB 20 is in contact with PR10 when region 11 arrives at the location of TAB 20. The leading section of region 11 is therefore smeared, indicating contact with TAB 20. Toward the trailing edge of region 11, however, TAB 20 disengages from region 11 and PR 10. The last section of region 11, as a result, is unsmeared. FIG. 8 shows the resulting ETAC voltage signal. As expected, it has an essentially opposite shape as the voltage signal in FIG. 6.

Referring again to FIG. 1, signals from ETAC 23 are typically analog voltage signals. In order to be read by many computers, such signals are first converted to digital signals by Analog/Digital Converter 24. Even if ETAC 23 signals are digital, some data conversion device may be necessary to convert the signals into a form readable by controller 221. Once converted, signals are sent to controller 221. Controller 221 also receives data from drive device 220 indicating the timing of activation and deactivation signals. Using signals such as those shown in FIGS. 3, 5 and 7, controller 221 can determine the relationship between the timing of activation and deactivation signals given to drive device 220 and the timing of TAB 20 engagement with and disengagement from PR 10. One embodiment for determining such relationships and making appropriate adjustments to the timing of activation and deactivation signals is shown in FIG. 8.

Referring to FIG. 8, step 801 indicates that an event commences the TAB timing adjustment sequence. Such events may be based on elapsed machine run time, number of imaging cycles, calendar time, or any similarly counted event. Commencement of the adjustment sequence may also be initiated by detected events related to machine performance or maintenance such as replacement of the TAB, photoreceptor, or other component affecting TAB timing or by detection of imaging defects such as image deletions that may be caused by faulty timing of TAB engagement or disengagement. However the sequence commences, at step 802, the system is directed to half-tone a selected region 11. At step 803, a signal is given to activate drive device 220. Such signal may be given by controller 221 itself or by another controller that controls drive device 220 more directly. At step 804, an ETAC sensor responds to the amount of toner detected on the charged imaging surface and such ETAC Voltage data is converted into a data stream readable by controller 221. At step 805, controller 221 determines the width of region 11. This width may be predetermined by the imaging control system or may be determined by an algorithm such as determining the length of ETAC signal showing voltage elevated over levels for untoned areas. At step 806, the controller determines, by timing the varying levels of voltage such as those shown in FIGS. 5 and 7, whether the TAB has engaged (or disengaged) within the section of region 11 that is within specifications. This specified section would normally be centered upon the middle of region 11 but may be specified differently. If controller 221 determines that TAB engagement (or disengagement) is not within specifications, then, at step 807, controller 221 calculates a timing adjustment to driving device 220 activation that is estimated to bring TAB engagement (disengagement) within specifications. As shown in FIG. 8, this estimate is tested by return to step 802. Alternatively, experience may indicate that, at least when the initial step 802–806 test is within a certain range, then a repeat of the test procedure is not necessary, and the system may go directly to step 809.

Step 808 is reached either by meeting of specifications in step 806 or, as described above, if the correction algorithm is expected to be accurate enough to yield the necessary correction. At step 808, the algorithm asks whether both engagement and disengagement have been tested to be within specifications. If not, then the sequence is returned to step 802 to test for whichever of the two processes have not been tested. Alternatively, experience may indicate that by accurately determining either engagement or disengagement, the reciprocal process may be sufficiently determinable. In any event, once the algorithm determines that both engagement and disengagement of the TAB has been sufficiently determined to be within specifications, then the timing sequence ends at step 809. At 810, the TAB is cleaned. One method of cleaning the TAB without adding additional hardware is to tamp the TAB repeatedly upon the PR in an interdocument zone in order to knock toner off the TAB. Without cleaning, it is possible that residual toner that transferred to the TAB during smearing will undesirably transfer to the back of copy substrates once imaging resumes.

In sum, by use of the apparatus and methods explained above, the timing of TAB engagement and disengagement may be adjusted automatically without requiring human intervention. In addition to saving maintenance time and minimizing the chances of human error, a further advantage is the ability to increase the frequency with which TAB timing is tested and adjusted. This increase in frequency may result in both improved imaging transfer with fewer deletions and improved photoreceptor wear since the chances of unintended TAB contact with the photoreceptor are decreased.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. An apparatus for adjusting the timing of contact between a transfer assist blade and a charged imaging surface in order that the timing be automatically adjusted within specifications, said apparatus comprising:

an imaging apparatus for developing a partially toned pattern having about 20 to about 80 percent coverage in a region of a charged imaging surface;

a transfer assist blade assembly, including a transfer assist blade, for moving a transfer assist blade between a position engaged with a surface and a position disengaged from such surface;

a drive device, connected to the transfer assist assembly, for imparting engagement and disengagement motion to the transfer assist blade, said drive device having an activation time for engaging the transfer assist blade with the surface and a deactivation time for disengaging the transfer assist blade from the surface;

a toner area coverage measuring device for measuring the percentage of the partially toned region that is covered by toner; and a controller, in communication with the drive device and area coverage measuring device, for adjusting the timing of activation of the drive device, wherein, in response to receiving signals from the toner area coverage measuring device indicating that the time of activation resulted in engagement of the transfer assist blade outside of the specifications, the controller adjusts the timing of activation accordingly.

2. The apparatus of claim 1, wherein the indication whether the time of activation results in engagement within or outside of specifications is determined based upon the portion of the partially toned region that is smeared by the transfer assist blade.

3. The apparatus of claim 1, wherein the toner area coverage measuring device emits a signal that varies voltage with the percentage of area coverage.

4. The apparatus of claim 1, wherein the imaging apparatus partially tones the region from about 40 to about 60 percent coverage.

5. The apparatus of claim 1, wherein the imaging apparatus partially tones the region about 50 percent.

6. The apparatus of claim 1, wherein the imaging apparatus partially tones the region in a halftone pattern.

7. The apparatus of claim 1, wherein the region is an interdocument zone.

8. The apparatus of claim 1, wherein the region encompasses a seam in the charged imaging surface.

9. The apparatus of claim 1, wherein the area coverage measuring device is a black toner area coverage sensor.

10. The apparatus of claim 1, wherein the controller, in response to receiving signals from the toner area coverage measuring device indicating that the timing of deactivation resulted in disengagement of the transfer assist blade outside of the specifications, adjusts the timing of deactivating the drive device in a manner that moves the transfer assist blade from an engaged position to a disengaged position at a time estimated to be within the specifications.

11. The apparatus of claim 1, wherein the controller commences the process of adjusting the timing of activating the drive device in response to detected events.

12. The apparatus of claim 1, wherein the controller commences the process of adjusting the timing of activation the drive device in response to counted events.

13. The apparatus of claim 1, wherein the toner area coverage sensor increases a voltage signal in response to detection of increased light reflection.

14. The apparatus of claim 1, further comprising a copy substrate leading edge detector wherein the timing of activation of the transfer assist blade is specified in order that engagement occur close to the leading edge of a copy substrate.

15. The apparatus of claim 1, further comprising a location indicator on the charged imaging surface and a sensor for detecting the location indicator wherein the timing of activation of the transfer assist blade is determined in relation to the time at which the location indicator is sensed.

16. An electrostatographic imaging system having specifications for engaging a transfer assist blade with a charged imaging surface, comprising:

a charged imaging surface;

an imaging apparatus for developing a partially toned pattern having about 20 to about 80 percent coverage in a region of a charged imaging surface;

a transfer assist blade assembly, including a transfer assist blade, for moving a transfer assist blade between a position engaged with a surface and a position disengaged from such surface;

a drive device, connected to the transfer assist assembly, for imparting engagement and disengagement motion to the transfer assist blade, said drive device having an activation time for engaging the transfer assist blade with the surface and a deactivation time for disengaging the transfer assist blade from the surface;

a toner area coverage measuring device for measuring the percentage of the partially toned region that is covered by toner; and a controller, in communication with the drive device and area coverage measuring device,.for adjusting the timing of activation of the drive device, wherein, in response to receiving signals from the toner area coverage measuring device indicating that the time of activation resulted in engagement of the transfer assist blade outside of the specifications, the controller adjusts the timing of activation accordingly.

17. A method for automatically adjusting the timing of engagement of a transfer assist blade with a charged imaging surface, comprising:

commencing a sequence for adjustment of the engagement timing;

developing a partially toned pattern having about 20 to about 80 percent coverage in a region of the charged imaging surface;

activating a drive device that moves a transfer assist blade from a disengaged position to an engaged position at a time estimated to engage the transfer assist blade within a specified portion of the partially toned region;

reading, by a controller, a signal from a toner area coverage sensor indicating the portion of the partially toned region that is smeared by the transfer assist blade;

determining, with a controller, from the signal from the toner area coverage sensor, whether the transfer assist blade engaged the charged imaging surface within specifications;

adjusting, in response to determining that the time of engagement was not within specifications, the time of activation of the drive device in order to meet specifications.

18. The method of claim 17, further comprising converting signals from the toner area coverage sensor into a form readable by the controller.

19. The method of claim 17, further comprising correlating the timing of detection of a copy substrate leading edge by a sensor with the timing of engagement by the transfer assist blade close to the leading edge of the copy substrate.

20. The method of claim 17, further comprising correlating the timing of detection of a location indicator on the charged imaging surface with the timing of engagement by the transfer assist blade close to the leading edge of the copy substrate.

21. The method of claim 17, wherein the step of developing comprises developing a partially toned pattern having about 40 to about 60 percent coverage.

22. The method of claim 17, wherein the step of developing comprises developing a partially toned pattern having about 50 percent coverage.

23. The method of claim 17, wherein the step of developing comprises developing a halftone pattern.

24. The method of claim 17, wherein the step of commencing is initiated by a counted event.

25. The method of claim 17, wherein the step of commencing is initiated by a detected event.

26. The method of claim 17, further comprising cleaning the transfer assist blade.

27. The method of claim 17, further comprising, after adjusting the time of activation, repeating the steps of developing, activating, reading and determining in order to verify that the time of engagement has been adjusted to within specifications.

28. The method of claim 17, further comprising determining the period of the toner area coverage sensor signal that corresponds with the width of the partially toned region.

29. The method of claim 17, further comprising:

deactivating the drive device in a manner that moves the transfer assist blade from an engaged position to a disengaged position at a time estimated to disengage the transfer assist blade within a specified portion of the partially toned region;

determining, with a controller, from the signal from the toner area coverage sensor, whether the transfer assist blade disengaged the charged imaging surface within specifications, and adjusting, in response to determining that the time of disengagement was not within specifications, the time of deactivation of the drive device in order to meet specifications.

30. The method of claim 17, wherein the partially toned region is an interdocument zone.

31. The method of claim 17, wherein the partially toned region encompasses a seam in the charged imaging surface.

32. The method of claim 17, wherein the step of reading further comprises detecting an increase in the toner area coverage sensor in response to detection of increased light reflection.

* * * * *